US006032661A

United States Patent [19]

Goff et al.

[11] Patent Number: 6,032,661

[45] Date of Patent: Mar. 7, 2000

[54] ARCHERY STRING RELEASE WITH SAFETY

[76] Inventors: Jerry Alan Goff; Sherwood L. Goff, both of 21595 Yankee Town Rd., Saucier, Mich. 39574

[21] Appl. No.: 09/081,688

[22] Filed: May 20, 1998

Related U.S. Application Data

[63] Continuation-in-part of application No. 08/939,295, Sep. 29, 1997, Pat. No. 5,944,004, which is a continuation-in-part of application No. 08/778,659, Jan. 3, 1997, Pat. No. 5,671,723.

[51] Int. Cl.[7] ..... F41B 5/18

[52] U.S. Cl. ..... 124/35.2

[58] Field of Search ..... 124/23.1, 24.1, 124/25.6, 35.2, 44.5, 86, 88

[56] References Cited

U.S. PATENT DOCUMENTS

| | | | |
|---|---|---|---|
| 4,282,851 | 8/1981 | Lyons | 124/35.2 |
| 4,300,301 | 11/1981 | Morrison | 42/70.06 |
| 4,672,945 | 6/1987 | Carlton | 124/35.2 |
| 4,962,747 | 10/1990 | Biller | 124/40 |
| 5,247,922 | 9/1993 | Lalonde | 124/35.2 |
| 5,448,983 | 9/1995 | Scott | 124/35.2 |
| 5,671,723 | 9/1997 | Goff et al. | 124/35.2 |

*Primary Examiner*—John A. Ricci
*Attorney, Agent, or Firm*—Seidel, Gonda, Lavorgna & Manaco, PC

[57] ABSTRACT

A mechanical string release with safety lock is disclosed. The release is particularly for use with an archery drawlock device to prevent accidental release of a bow string when the drawlock is carried in drawn and latched condition. The release has a trigger extending outward from the body. The safety lock comprises a bar rotatably mounted on the body adjacent the trigger. The bar is adapted to selectively engage and detain the trigger upon rotation of the bar in one direction, thereby preventing actuation of the trigger. The bar also is adapted to selectively disengage the trigger upon counter rotation of the bar, thereby allowing actuation of the trigger. In the preferred embodiment, the bar is rotatably mounted on a pin attached to the body.

5 Claims, 4 Drawing Sheets

ARCHERY STRING RELEASE WITH SAFETY

CROSS-REFERENCE TO RELATED APPLICATION

This application is a continuation-in-part of application Ser. No. 08/939,295, entitled "Archery Stabilizer And Drawlock", filed Sep. 29, 1997, now U.S. Pat. No. 5,944,004, which is a continuation-in-part of application Ser. No. 08/778,659, entitled "Archery Drawlock", filed Jan. 3, 1997, which issued as U.S. Pat. No. 5,671,723 on Sep. 30, 1997.

FIELD OF THE INVENTION

The present invention relates to the general field of archery bow accessories, and to the more specific field of safety devices which lock a mechanical string release to prevent accidental release of the bow string.

BACKGROUND OF THE INVENTION

Mechanical bow string releases for archery are commonplace, and are of a wide variety. Those with a trigger or button release usually do not have a safety to lock the trigger or button. Since the bow is drawn and held on target for only a brief period, a safety should not be necessary. On a bow equipped with a drawlock, however, the bow may be held or carried in full draw for considerable time, creating the possibility of accidentally releasing the string or of accidentally launching an arrow by unintentional contact with the release trigger.

Drawlocks of various types have been used by archers and bow hunters for many years. The drawlock disclosed in U.S. Pat. No. 5,671,723 (Goff, et al.) co-invented by the present inventor, provides a modern drawlock for the contemporary design of a compound bow equipped with an overdraw arrow rest. That drawlock includes a mechanical bow string release, and the patent specification describes that since the drawlock system permits the bow to be carried in a full draw position, the release should have a trigger safety of some type. The specification suggests the possibility of a cross-bar type safety such as used in the trigger guard of firearms.

Other prior art references disclose types of safety lock devices for archery bow string releases. For example, U.S. Pat. Nos. 4,287,851 (Lyons) and 4,672,945 (Carlton) describe bow string releases with safeties similar to the crossbar type suggested in Goff et al. U.S. Pat. No. 5,247,922 (Lalonde) discloses a bow string trigger with a safety lock that includes a bow string trigger lever, a gripper release lever, a bow string gripper and a safety lock lever. In the safe position, the safety lock lever engages a notch in the trigger lever and is biased in that position by a spring.

Upon further contemplation, it appears to the present inventor that the crossbar type safety may not be optimally suited for a bow string release, and that it would be difficult to install a crossbar safety as an add-on to an existing string release that does not already have a safety. Consequently, an objective of this invention is a safety lock for a bow string release which is simpler than the prior art safety locks in construction and operation. Another objective is that the safety be easily added to a common type of string release. Further advantages of the invention may be appreciated by reading the following descriptions.

SUMMARY OF THE INVENTION

The present invention is a bow string release with a safety lock. The release has a body and a trigger extending outward from the body. The safety lock comprises a bar rotatably mounted on the body behind the trigger and adapted to engage and detain the trigger upon rotation of the bar in one direction, thereby preventing actuation of the trigger from the cocked position to the release position. The bar also is adapted to disengage the trigger upon counter rotation of the member, thereby allowing actuation of the trigger to the release position.

In the preferred embodiment, the safety lock is rotatably mounted on a pin attached to the body of the release, and the contour of the bar forms a blocking post and a finger lever.

Another aspect of the present invention is an archery drawlock device having a string release with a safety lock of the present invention.

BRIEF DESCRIPTION OF THE DRAWINGS

The drawings show a form of the invention which is presently preferred; however, the invention is not limited to the precise arrangement shown in the drawings.

DETAILED DESCRIPTION OF A PREFERRED EMBODIMENT

This is a continuation of a parent application directed to an archery drawlock and now issued as U.S. Pat. 5,671,723. The description of the drawlock portion of the invention which follows is essentially the same as the description in that patent. The new material is in the string release with a particular safety.

The Drawlock

Figure 1:
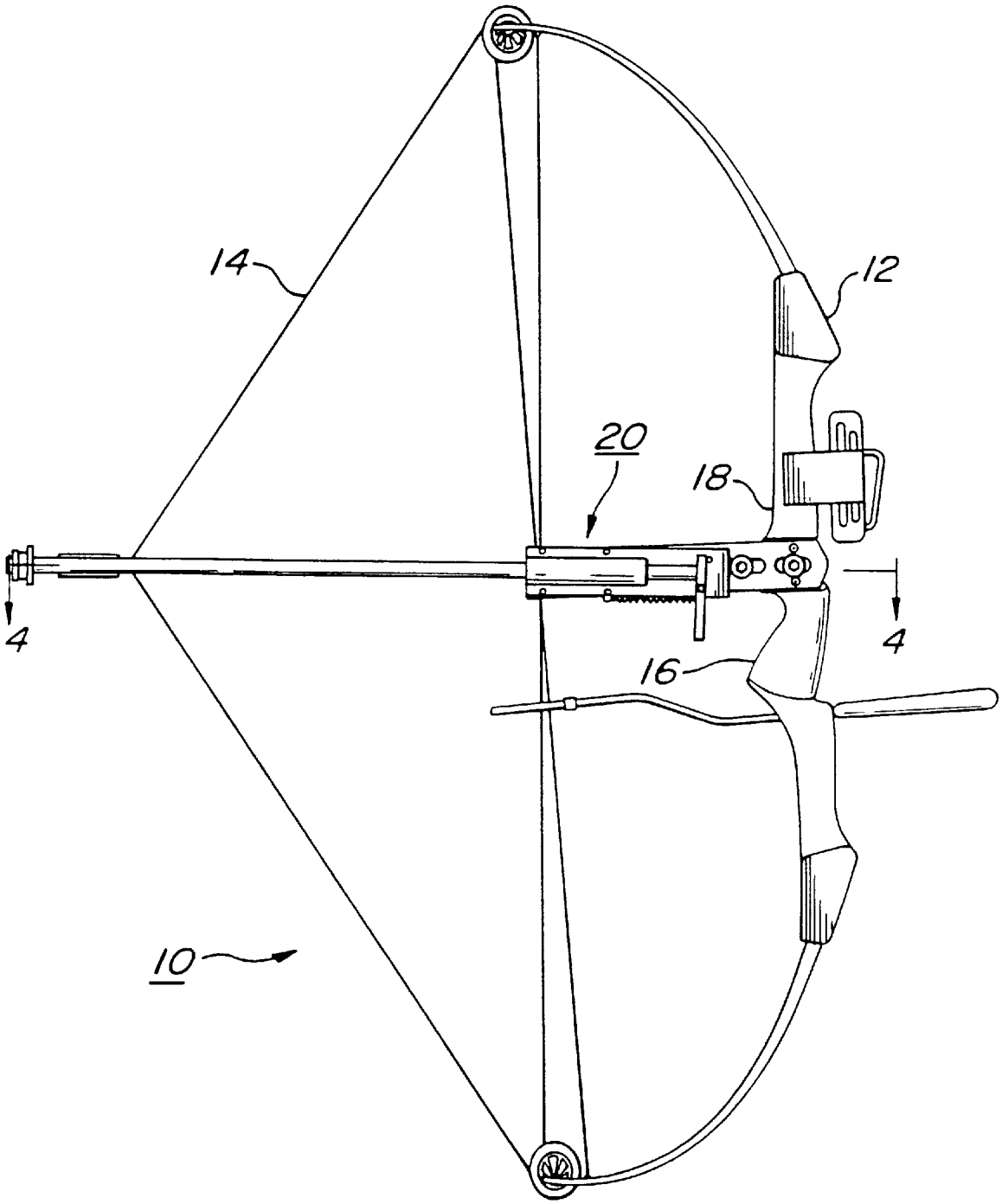
FIG. 1 is a side view of a compound bow on which a drawlock is attached for a right-handed archer, and is shown in the drawn and locked position.

FIG. 1 shows a generic compound bow (10) having a handle (12), upper and lower limbs each having an eccentric wheel, a bowstring (14), a cable guard, a stabilizer, and a bow sight (the unnumbered elements are easily identified and not significant to a description of the invention). The handle is designed for a "right-handed" archer; that is, an archer who grips the handle with his left hand and draws the bow with his right hand. Consequently, the handle has a grip (16) conforming ergonomically to a left hand grasp. Directly above the grip on the palm side is a sight window (18). The sight window is a "center-shot" configuration, in that the sight window is cut past the vertical centerline of the handle to allow clearance for the arrow fletching and sideways arrow rest adjustment. In this bow's normal configuration, an arrow rest would be attached in the sight window. However, in the configuration depicted and described herein, the bow will be equipped with an "overdraw" arrow rest.

Figure 2:
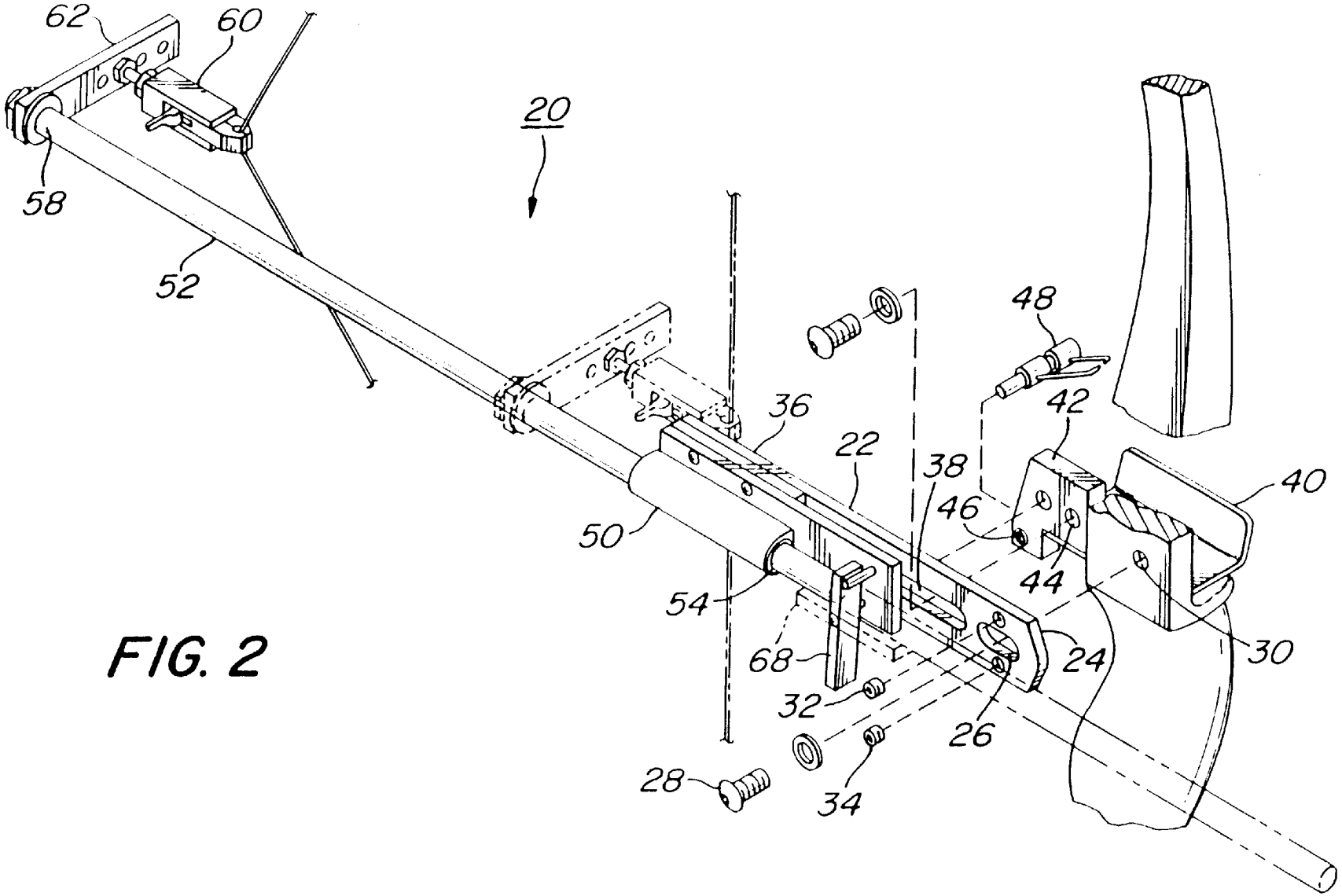
FIG. 2 is a perspective view of the drawlock of FIG. 1, exploded from the bow, and shown by ghost lines in an undrawn position.
Figure 4:
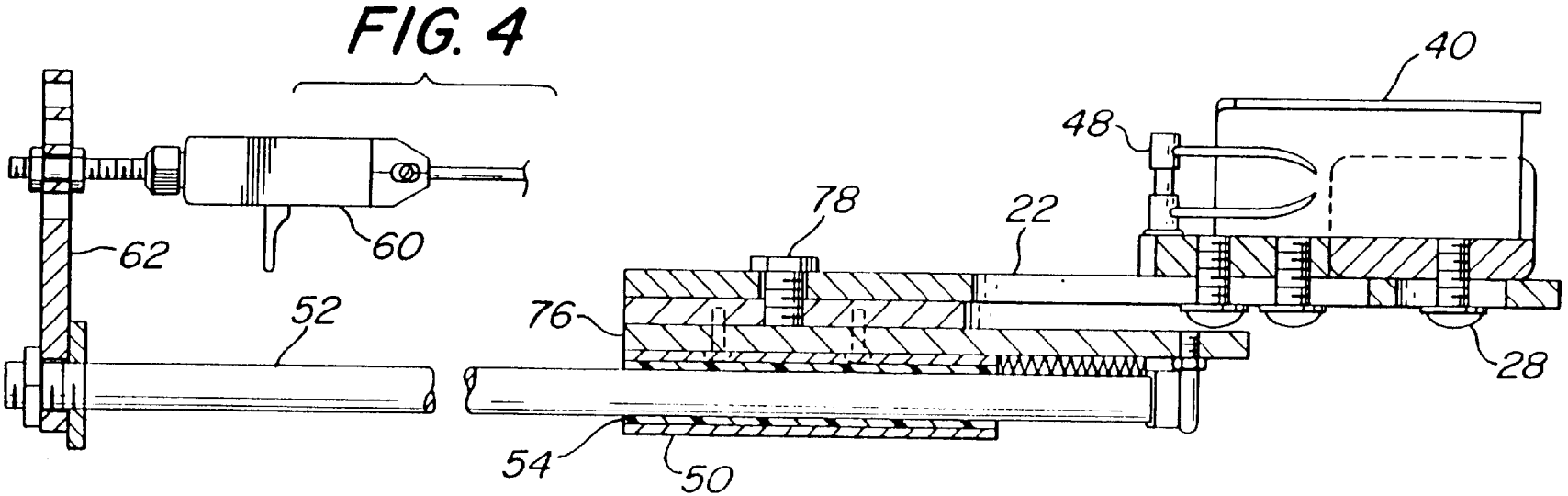
FIG. 4 is a top view of portions of the drawlock of FIG. 1.

As shown in FIGS. 2 and 4, the drawlock device (20) includes an elongated mounting bracket (22). At the forward end (24) of the bracket (22) is the means by which the bracket is attached to the handle of the bow. An aperture (26) through the forward end of the bracket allows the shaft of a threaded bolt (28) to be screwed into a pre-drilled and taped arrow rest hole (30) in the handle, with the head of the bolt (28) tightened down against the mounting bracket (a washer may be inserted between bolt head and bracket). Set screws (32, 34) are located above and below the aperture (26) and are tightened against the handle to lock the bracket in a position generally perpendicular to the handle. The aperture (26) is a short slot aligned with the long axis of the bracket (22), as depicted in the drawings. The slot-aperture (26) allows the bracket to be adjusted slightly fore or aft of the pre-drilled arrow rest hole (30) before tightening the bolt 28, so that the set screws can be positioned against a flat surface of the handle. Otherwise, the aperture (26) could be merely a round hole of proper diameter.

Behind the aperture (26), and intermediate the forward end (24) and the rearward end (36) of the mounting bracket is the means by which an overdraw arrow rest can be supported at a selectable position to the rear of the bow's handle. An elongated slot (38), having a longitudinal axis generally aligned along the long axis of the mounting bracket (22), is adapted to receive a bolt coupling an overdraw shelf and arrow rest to the bracket. In the embodiment depicted, the overdraw shelf (40) is attached to a mounting plate (42) which has one or two bolt holes (44) and a threaded port (46) for the attachment of a variety of arrow rests. The arrow rest (48) depicted is a launcher-style rest with a two-prong arrow support, but other types of rest can be used. The concept of the overdraw rest is that the arrow is supported behind the grip, enabling full draw with a shorter, lighter arrow. The length of the elongated slot (38) permits this overdraw distance to be adjusted between approximately one to five inches behind the grip. The overdraw arrow rest and shorter arrow shaft place the hunting broadhead behind the bow hand and wrist at full draw. The overdraw shelf provides a guard for the hand and wrist if the arrow jumps the rest at or before string release.

The drawlock device (20) further includes a draw tube (50) attached to the mounting bracket (22) near the rearward end (36) of the bracket. The tube (50) is intended to allow telescoping movement of a draw rod (52). The draw tube is preferably a metal exterior tube lined with a soft bushing (54) of material such as PVC or other plastic composition to eliminate the noise that would be produced by metal-to-metal contact with the draw rod. The draw rod (52) has a blunt end (56) for insertion through the draw tube and a second, opposite end (58) which supports a bow string mechanical release (60) or releasing apparatus. The preferred type release is the style known as a "caliper" release with a free-swiveling head and a trigger. Since the draw lock system permits the bow to be carried in a full draw position, a preferred release would include a trigger safety lock, such as the release (80) shown in FIGS. 5 and 6, and described in greater detail under the heading "String Release with Safety" below.

A spacer bar (62) is used to space the release (60) a proper distance from the draw bar. One end of the spacer bar is attached to the back end (58) of the draw rod. The spacer bar has several attachment holes to attach the release at a selectable distance from the draw bar, depending upon the thickness of the grip and location of the eccentric cable tracks (the string on a compound bow should be aligned with the cable track of the eccentric wheels). The spacer bar (62) further serves as a finger grip to draw the string.

The drawlock device (20) further includes a latching means for locking and holding the draw rod at a full-draw position. The latching means includes a pivot pin (64) located on the mounting bracket (22) on one side of the elongated slot (38), and a stop pin (66) located on the opposite side of the slot (38), generally directly across the slot from the pivot pin. A latch bar (68) is rotatably mounted on the pivot pin (64) at a position intermediate the ends of the bar (68). The length of the bar from a first end (70) to the pivot pin (64) is greater than the distance between the pivot pin (64) and the stop pin (66). A spring (72) is attached to the latch bar between the pivot pin and the opposite, second end (74) of the bar, and the other end of the spring is attached to the mounting bracket to the rear of the pivot pin (66). The spring is biased to pivot the first end of the bar toward the stop pin. When the draw rod is in the undrawn position shown by ghost lines in FIGS. 2 and 3, the latch bar lies along the rod with the spring tensioned. When the string is drawn past fulldraw position, the draw rod moves past the first end of the latch bar, and the spring causes the bar to pivot across the slot (38) until the bar strikes the stop pin (66). The draw can then be relaxed slightly to bring the blunt end of the rod into contact against the bar. The pressure of the drawn string will the hold the rod firmly against the bar, effectively locking the bow in a full-draw position. (The term "full-draw" is used herein to mean the aimed draw position for a bow properly matched to the archer, rather than an absolute maximum draw.) This latching means achieves the objective of providing a superior and more positive latching of the drawlock rod at full draw than found in prior drawlocks.

Figure 3:
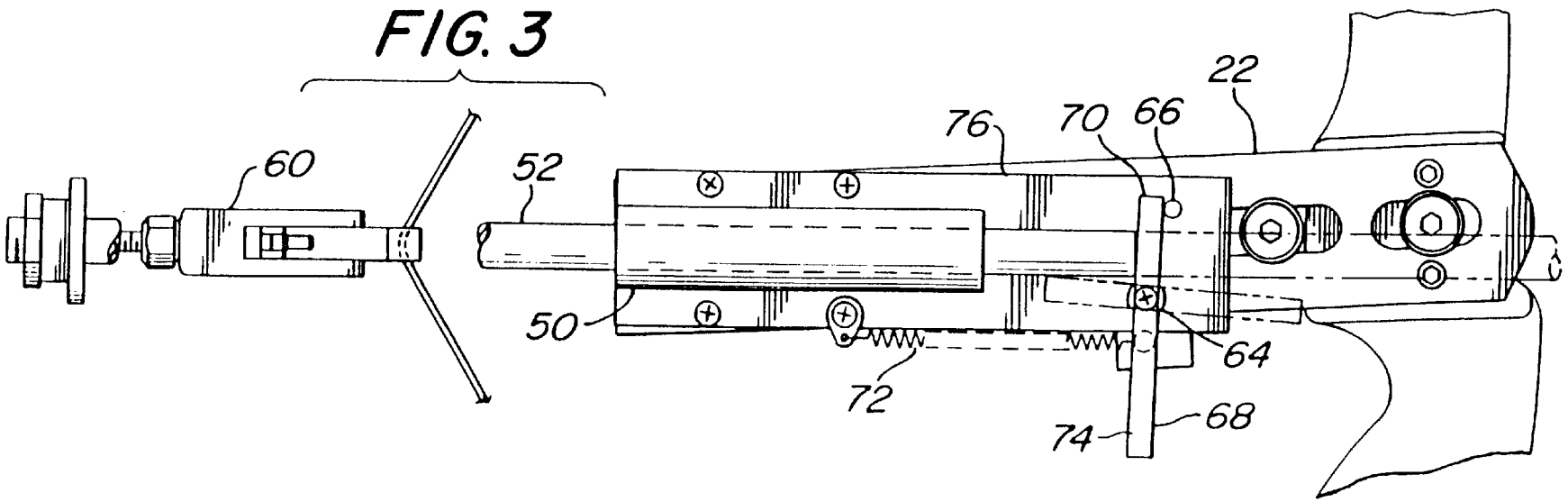
FIG. 3 is a side view of portions of the drawlock of FIG. 1, showing the mechanical string release and the draw rod latching mechanism in greater detail.

As shown in FIG. 3, a preferred embodiment is that in which the draw tube (50), pivot pin (64), stop pin (66) and spring (72) are mounted on a mounting plate (76) which can be attached to the mounting bracket (22) at a selectable angle, such as by a bolt (78). This allows the axis of the tube to be aligned with the axis of the arrow from nock point to rest, which may be at an angle slightly above or below the axis of the mounting bracket, depending upon the tuning needed to eliminate vertical wobble of the arrow in flight. By aligning the draw tube with the arrow, the draw rod is centered in the tube during the draw, eliminating any additional draw weight which would be caused by friction between tube and rod in an off-center alignment. However, even with this selectable angle plate, the stop pin is still on the opposite side of the slot from the pivot pin and still generally directly across the slot from the pivot pin.

Although the drawlock device is described herein as it is mounted on a right-handed bow, it can easily be seen that the device is just as adeptly mounted on a left-hand bow. The mounting bracket merely inverts top to bottom when it is mounted on a left-hand bow, with the only asymmetry being that the pivot pin and spring are now above the slot (38) instead of below it. However, the spring will still pull the latch bar across the slot and into the stop pin in exactly the same manner when the draw rod is retracted beyond full draw.

The overdraw device can be used in several modes. The arrow can be nocked with the bow undrawn, then the bow can be drawn when the game animal approaches and briefly locked in the drawn position until the quarry presents a clear target at a vulnerable aspect. Alternatively, the bow can be drawn and locked at the carry with no arrow loaded until the hunter reaches a stand or game is sighted.

String Release With Safety

Figure 6:
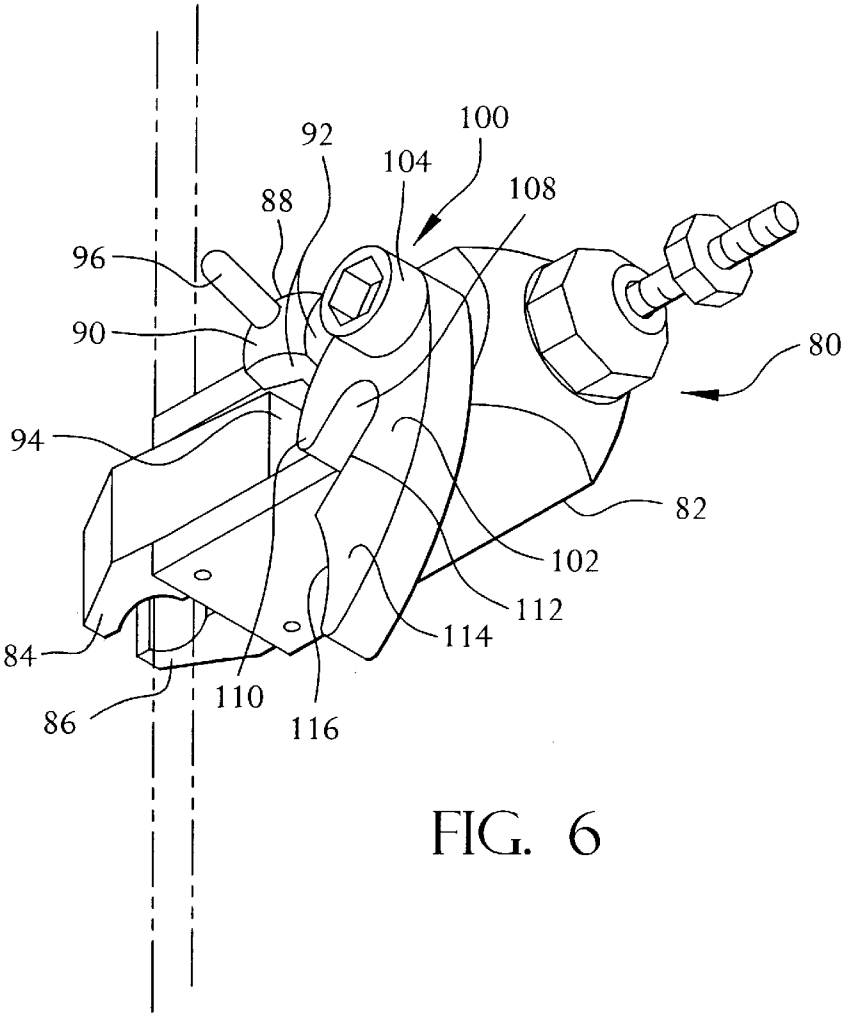
FIG. 6 is a perspective view of the safety lock of the present invention and a mechanical string release in the unlocked position.
Figure 5:
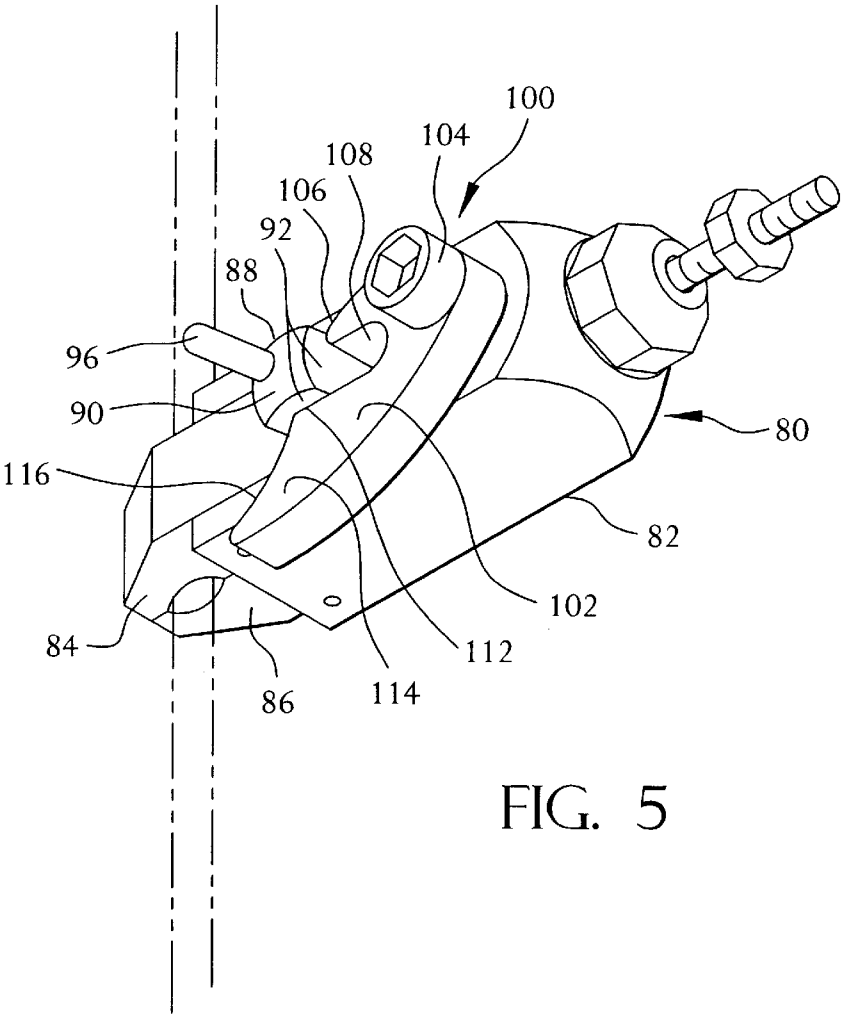
FIG. 5 is a perspective view of the safety lock of the present invention and a mechanical string release in the locked position.

Since the draw lock system permits the bow to be carried in a full draw position, the mechanical string release (80)

shown in FIGS. 5 and 6 has a trigger safety lock. FIG. 5 shows the safety lock in the locked or safety position, and FIG. 6 shows it in the unlocked or shooting position. Although the string release is depicted as mounted on a drawlock, a release with a safety as described herein may also be used without a drawlock, as for example with a wrist strap attachment.

The string release is of the type often referred to as a "caliper" type release, and is generally similar in its functional aspects to the release disclosed in U.S. Pat. No. 4,282,851 (Lyons). A commercial embodiment, used to make the release of FIGS. 5 and 6, is sold under the trademark BRACKLYNN®. The release has a body (82) containing inside it a latching cam (not shown) to hold the spring-biased jaws (84, 86) closed together, and a trigger mechanism (88) connected to the latching cam and extending outward from the body. The trigger of this particular release has a pedestal portion (90) with flat sides (92) extending from the latching cam through a slot (94) in the body, capped by a rounded pin portion (96) for the archer to toggle to release the string. Rearward actuation of the trigger from a cocked position jaws closed) to a release position trips the latching cam and allows the spring bias to open the jaws, releasing the bow string. These functions and the structure of this type of release is well known.

A safety mechanism (100) is rotatably mounted on the body (82) adjacent to and behind the trigger (88). In the preferred embodiment, a threaded bore is drilled and tapped in the body to permit a safety bar (102) to be mounted on a threaded metal pin (104) screwed into the bore. The bar (102) is preferably made of plastic to reduce weight, but can be of metal or other composition.

The bar (102) has a trigger blocking portion therein adapted to selectively engage and lock the trigger (88) when the bar is rotated to place the blocking portion against the rear flat (92) of the trigger pedestal (90), as in FIG. 5, and to disengage the trigger upon counter rotation of the bar to allow actuation of the trigger and release of the bow string, as in FIG. 6.

In the preferred embodiment depicted, the blocking portion is formed by a specific contour of the bar (102). Starting behind the pin (104), one side (106) of the bar extends in curved contour a sufficient length to reach and contact the rear flat side (92) of the pedestal (90) when the trigger (88) is cocked, then the curvature reflects in a "U" shape to form a notch (108) in the bar. A small rounded surface post (110) is thus created to physically block the trigger from rearward movement. The contour continues as a straight line on the opposite side of the U-shaped notch to a length longer than the blocking post (110) to form a flat portion (112) that will contact the flat side (92) of the trigger pedestal (90) and act as a rotational limit stop for the bar (102).

The bar (102) also has a finger lever portion (114) to assist the shooter in rotating the bar to set or remove the blocking post (110) from contact with the trigger (88). In the preferred embodiment depicted, the contour of the bar continues after the flat portion in a reverse (concave) curvature to form a finger tab (116), and then reflects in a convex curvature back to the starting point behind the pin (104). This creates a finger-adapted lever to apply sufficient torque to force the blocking post behind the trigger and to overcome that force to rotate the blocking surface out of contact with the trigger.

This invention may be embodied in other forms. For example, the blocking surface of the bar could be a flat surface without a notch, or the lever portion could have a different shape. The release trigger may also have a different configuration. For example, a release such as shown in FIGS. 2, 3 and 4 has a narrow trigger with flat rear and side faces instead of a pedestal and pin configuration. Reference should be made to the following claims to determine the scope of the invention.

What is claimed is:

1. A bow string release for selectively engaging and releasing a bow string, the release comprising:

a body;

a trigger extending outward from the body and having a pedestal portion with flat sides; and a bar rotatably mounted on the body behind and adjacent the trigger, the bar being adapted to selectively engage and detain the pedestal portion of the trigger upon rotation of the bar in one direction, thereby preventing rearward actuation of the trigger, and to disengage the pedestal portion of the trigger upon counter rotation of the bar, thereby allowing rearward actuation of the trigger.

2. A release as in claim 1, wherein the bar is rotatably mounted on a pin attached to the body.

3. A release as in claim 2, wherein the bar comprises a blocking post and a finger lever, the lever adapted to apply a sufficient torque to force the blocking post behind and against a rear flat side of the pedestal.

4. An archery drawlock device having a release as in claim 3.

5. An archery drawlock device having a release as in claim 1.

* * * * *